US011744383B2

(12) United States Patent
Kappenman

(10) Patent No.: US 11,744,383 B2
(45) Date of Patent: Sep. 5, 2023

(54) MATTRESS

(71) Applicant: Bed Patent Holdings Limited Liability Company, Las Vegas, NV (US)

(72) Inventor: Kevin J. Kappenman, Huntington Beach, CA (US)

(73) Assignee: BED PATENT HOLDINGS LIMITED LIABILITY COMPANY, Las Vegas, NV (US)

( * ) Notice: Subject to any disclaimer, the term of this patent is extended or adjusted under 35 U.S.C. 154(b) by 96 days.

(21) Appl. No.: 17/372,230

(22) Filed: Jul. 9, 2021

(65) Prior Publication Data

US 2022/0022660 A1 Jan. 27, 2022

Related U.S. Application Data

(60) Provisional application No. 63/055,089, filed on Jul. 22, 2020.

(51) Int. Cl.
*A47C 27/00* (2006.01)
*A47C 27/05* (2006.01)
*A47C 27/045* (2006.01)

(52) U.S. Cl.
CPC ..... *A47C 27/056* (2013.01); *A47C 27/0453* (2013.01)

(58) Field of Classification Search
CPC . A47C 27/0453; A47C 27/056; A47C 27/142; A47C 27/15; A47C 27/00; A47C 27/04
See application file for complete search history.

(56) References Cited

U.S. PATENT DOCUMENTS 4,777,681 A * 10/1988 Luck ..... A47C 27/15 5/691
4,903,359 A * 2/1990 Rogers ..... A47C 27/148 5/730
5,667,871 A * 9/1997 Goodrich ..... B31C 5/00 428/338
5,705,252 A * 1/1998 Lea ..... A47C 27/144 428/158
5,967,788 A * 10/1999 Udoh ..... G09B 23/04 434/211

(Continued)

FOREIGN PATENT DOCUMENTS

EP 2929813 A1 * 10/2015 ..... A47C 27/144
EP 2929813 B1 * 8/2016 ..... A47C 27/144

(Continued)

*Primary Examiner* — Fredrick C Conley
(74) *Attorney, Agent, or Firm* — Blue Capital Law Firm, P.C.

(57) ABSTRACT

A mattress includes a layer including a first surface and a second surface arranged opposite to the first surface. The layer defines a plurality of slits extending from the first surface to the second surface and arranged in a plurality of rows extending in a longitudinal direction. The slits in each row are arrayed linearly in the longitudinal direction and are disposed spaced apart from each other. The rows of the slits restrict a compression of the layer to an area under loading and prevent the surrounding portion of the layer from being pulled towards the area under loading.

18 Claims, 3 Drawing Sheets

(56) References Cited

U.S. PATENT DOCUMENTS

| | | | | |
|---|---|---|---|---|
| 2010/0071136 | A1* | 3/2010 | Weber | A47G 9/1081<br>156/251 |
| 2015/0265063 | A1* | 9/2015 | Cappadona | A47C 31/001<br>5/724 |
| 2020/0229607 | A1* | 7/2020 | Ribicic | A47C 27/056 |

FOREIGN PATENT DOCUMENTS

| | | | | |
|---|---|---|---|---|
| WO | WO-2017006190 | A1 * | 1/2017 | A47C 27/144 |
| WO | WO-2018149523 | A1 * | 8/2018 | A47C 27/05 |

* cited by examiner

MATTRESS

CROSS-REFERENCE TO RELATED APPLICATIONS

This application claims priority to and the benefit of U.S. Provisional Patent Application No. 63/055,089, filed on Jul. 22, 2020, the contents of which are hereby incorporated by reference herein for all purposes.

TECHNICAL FIELD

The present disclosure relates generally to a mattress, and more particularly to a mattress having a foam structure including a plurality of slits to restrict a compression of the mattress to the areas under loading.

BACKGROUND

Mattresses typically include a foam layer disposed over a support layer that may include coil springs, water chambers, air chambers, foam etc. The foam layer is adapted to compress when the user lies on the mattress. In many instances however, foam layers have predictable shortcomings. One common shortcoming is that when foam is compressed, a concave depression can form, affecting the sleep experience of another person on the bed. Due to the formation of concave depression, sleeping partners may find themselves pulled or leaning towards the other party that they are sharing the mattress with. The concave depression (especially in very firm foams) can cause the posture to be affected negatively with their body in a position known as "kyphosis", where the body is anatomically turned in on itself. Some foam also transfer motion readily from one side of the bed to the other. Another limitation of a layer of foam used in a mattress is that there is typically only one density or ILD (interior load deflection) to the foam.

SUMMARY

According to an aspect of the disclosure, a mattress is provided. The mattress includes a layer including a first surface and a second surface arranged opposite to the first surface. The layer defines a plurality of slits extending from the first surface to the second surface and arranged in a plurality of rows extending in a longitudinal direction. The slits in each row are arrayed linearly in the longitudinal direction and are disposed spaced apart from each other. The rows of the slits restrict a compression of the layer to an area under loading and prevent the surrounding portion of the layer from being pulled towards the area under loading.

In one embodiment, the plurality of rows includes a plurality of first rows and a plurality of second rows arranged adjacent to the plurality of first rows. The slits of the first rows and the slits of the second rows are arranged in an inline arrangement. The plurality of rows also includes a plurality of third rows arranged adjacent to the plurality of second rows such that a single second row is arranged between a single first row and a single third row. The slits of the third row and the slits of the second row are arranged in a staggered arrangement. Moreover, the plurality of rows includes a plurality of fourth rows arranged adjacent to the plurality of third rows such that a single third row is arranged between a single fourth row and a single second row and the single fourth row is arranged between an adjacently arranged single third row and an adjacently arranged single first row. The slits of the fourth row and the slits of the third row are arranged in an inline arrangement.

In one embodiment each first row includes a number of slits arranged spaced apart from each other such that a first gap is defined between two consecutively arranged slits of the first row, and each second row includes a number of slits arranged spaced apart from each other such that a second gap is defined between two consecutively arranged slits of the second row. The second gap is disposed facing the first gap of the adjacently arranged first row and completely overlaps the facing first gap.

In one embodiment, each third row includes a number of slits arranged spaced apart from each other such that a third gap is defined between two consecutively arranged slits of the third row. The third gap is arranged facing the slit of the adjacently arranged second row such that the slit of the adjacently arranged second row completely overlaps the facing third gap. Further, each fourth row includes a number of slits arranged spaced apart from each other such that a fourth gap is defined between two consecutively arranged slits of the fourth row. The fourth gap is disposed facing the third gap of the adjacently arranged third row and completely overlaps the facing third gap.

In one embodiment, the fourth gap is arranged facing the slit of the adjacently arranged first row such that the slit of the adjacently arranged first row completely overlaps the facing fourth gap.

In one embodiment, the mattress further includes a support structure supporting the layer and includes a plurality of springs.

In one embodiment, the layer is a first layer and the mattress includes a second layer attached to the second surface of the first layer.

In one embodiment, the second layer includes a convex shape when viewed from a longitudinal side of the mattress.

In one embodiment, an apex of the second layer is offset from a middle line of the mattress.

In one embodiment, the first layer is made of foam and the second layer is made of foam having a density higher than a density of the first layer.

According to an aspect of the disclosure, a mattress is provided. The mattress includes a base structure and a foam structure attached to the base structure and supported on the base structure. The foam structure includes a layer having a first surface and a second surface arranged opposite to the first surface and defining a plurality of slits extending from the first surface to the second surface and arranged in a plurality of rows extending in a longitudinal direction. The slits in each row are arrayed linearly in the longitudinal direction and are disposed spaced apart from each other. The rows of the slits restrict a compression of the layer to an area under loading and prevent the surrounding portion of the layer from being pulled towards the area under loading.

In one embodiment, the plurality of rows includes a plurality of first rows and a plurality of second rows arranged adjacent to the plurality of first rows. The slits of the first rows and the slits of the second rows are arranged in an inline arrangement. The plurality of rows also includes a plurality of third rows arranged adjacent to the plurality of second rows such that a single second row is arranged between a single first row and a single third row. The slits of the third row and the slits of the second row are arranged in a staggered arrangement. Moreover, the plurality of rows includes a plurality of fourth rows arranged adjacent to the plurality of third rows such that a single third row is arranged between a single fourth row and a single second row and the single fourth row is arranged between an adjacently arranged single third row and an adjacently arranged single first row. The slits of the fourth row and the slits of the third row are arranged in an inline arrangement.

In one embodiment each first row includes a number of slits arranged spaced apart from each other such that a first gap is defined between two consecutively arranged slits of the first row, and each second row includes a number of slits arranged spaced apart from each other such that a second gap is defined between two consecutively arranged slits of the second row. The second gap is disposed facing the first gap of the adjacently arranged first row and completely overlaps the facing first gap.

In one embodiment, each third row includes a number of slits arranged spaced apart from each other such that a third gap is defined between two consecutively arranged slits of the third row. The third gap is arranged facing the slit of the adjacently arranged second row such that the slit of the adjacently arranged second row completely overlaps the facing third gap. Further, each fourth row includes a number of slits arranged spaced apart from each other such that a fourth gap is defined between two consecutively arranged slits of the fourth row. The fourth gap is disposed facing the third gap of the adjacently arranged third row and completely overlaps the facing third gap.

In one embodiment, the fourth gap is arranged facing the slit of the adjacently arranged first row such that the slit of the adjacently arranged first row completely overlaps the facing fourth gap.

In one embodiment, the support structure includes a plurality of springs attached to the foam structure and supporting the foam structure.

In one embodiment, the layer is a first layer, and the foam structure includes a second layer sandwiched between the first layer and the support structure and attached to the second surface of the first layer.

In one embodiment, the second layer includes a convex shape when viewed from a longitudinal side of the mattress.

In one embodiment, an apex of the second layer is offset from a middle line of the mattress.

In one embodiment, the first layer is made of foam and the second layer is made of foam having a density higher than a density of the first layer.

For a more complete understanding of the present disclosure, reference is made to the following detailed description and accompanying drawings. In the drawing, like reference characters refer to like parts throughout the views in which:

DETAILED DESCRIPTION

Reference will now be made in detail to specific embodiments or features, examples of which are illustrated in the accompanying drawings. Generally, corresponding reference numbers will be used throughout the drawings to refer to the same or corresponding parts. Also, wherever possible, the same reference numbers will be used throughout the drawings to refer to the same or the like parts.

Figure 1:
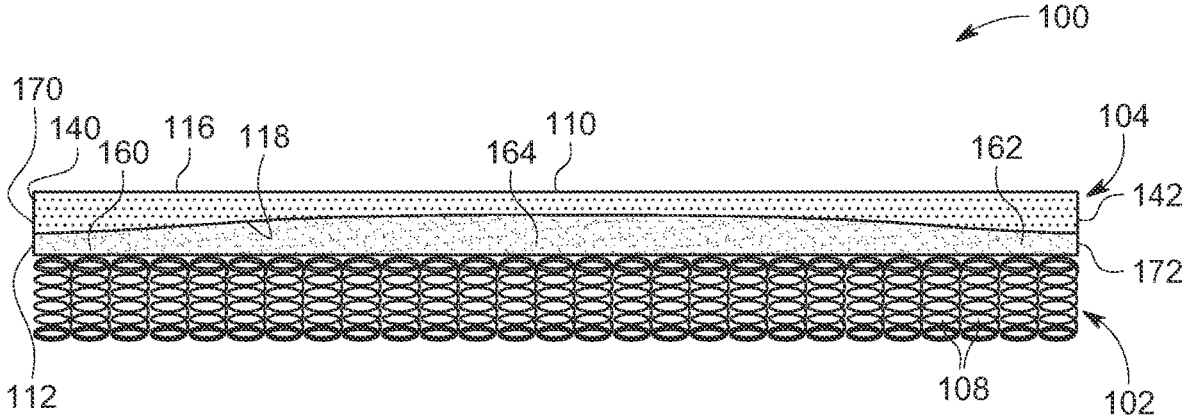
FIG. 1 illustrates a side view of a mattress, in accordance with an embodiment of the disclosure.

Referring to FIG. 1, a mattress 100 including a support structure 102 (i.e., base structure 102), and a foam structure 104 arranged above the support structure 102 is shown. As shown, the support structure 102 may include a plurality of springs 108 to the support the foam structure 104 and adapted to support a person. Although, the support structure 102 having the plurality of the springs 108 is shown, it may be appreciated that the support structure 102 may include water chambers, air chambers, various hoop assemblies, foam, or any other suitable components to support a load of the user. In an embodiment, the support structure 102 may include a base layer (not shown) for supporting the plurality of springs 108. The base layer may include a foam based material having a density in a range of 20 indentation load deflection (ILD) to 50 ILD and may include a substantially rectangular structure. Although, the rectangular structure is contemplated for the base layer, it may be envisioned that the base layer may include any other suitable structure, such as, but not limited to, a circular structure, an elliptical structure, a square structure, or any other suitable structure known in the art.

Figure 2:
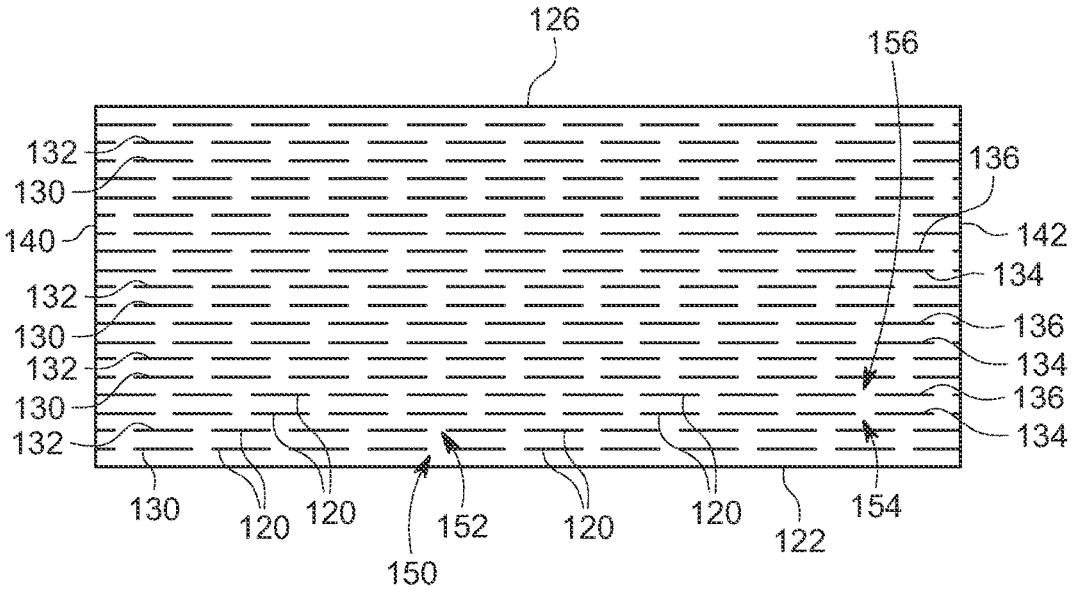
FIG. 2 illustrates a top view of a first layer of the mattress depicting an arrangement of a plurality of slits of the first layer, in accordance with an embodiment of the disclosure.
Figure 3:
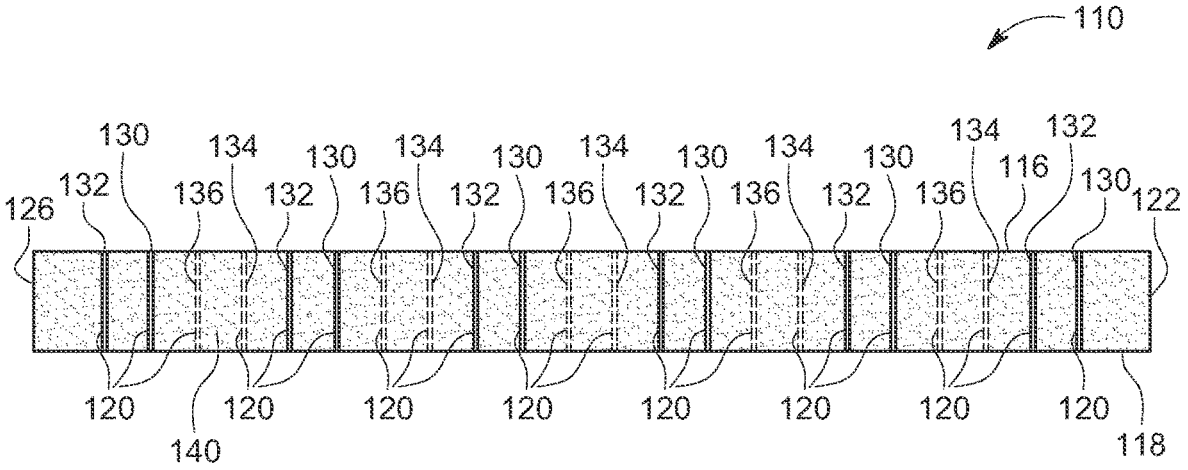
FIG. 3 illustrates an end view of the first layer, in accordance with an embodiment of the disclosure.
Figure 4:
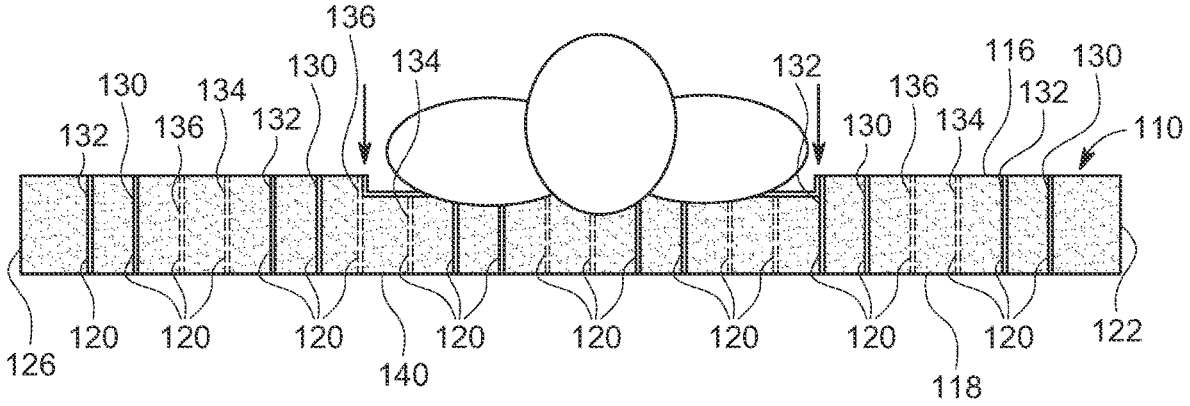
FIG. 4 illustrates an end view of the first layer with a user lying on the mattress, in accordance with an embodiment of the disclosure.

Further, the foam structure 104 abuts the support structure 102 and is supported on the support structure 102. The foam structure 104 facilitates in ergonomically aligning the back or lumber portion of the person by providing additional cushioning to a shoulder portion and hip portion when the person lies on the mattress 100. The foam structure 104 may include a first layer 110 and a second layer 112 sandwiched between the first layer 110 and the support structure 102 and abutting the support structure 102. The first layer 110 includes a first surface 116 (i.e., the top surface 116) and a second surface 118 (i.e., the bottom surface 118) disposed opposite to the first surface 116 and adapted to contact the second layer 112. Referring to FIGS. 2, 3 and 4, the first layer 110 defines a plurality of slits 120 extending through an entire thickness of the first layer 110 from the first surface 116 to the second surface 118. Further, each slit 120 extends substantially parallel to a length of the first layer 110. Accordingly, each slit 120 extends substantially parallel to a first longitudinal side 122 and/or the second longitudinal side 126 of the first layer 110. Further, the slits 120 are arranged in a plurality of rows, for example, a plurality of first rows 130, a plurality of second rows 132, a plurality of third rows 134, and a plurality of fourth rows 136.

As shown in FIG. 2, each first row 130 extends from a first longitudinal end 140 of the first layer 110 to a second longitudinal end 142 of the first layer 110 and includes a number of slits 120 arrayed linearly along a longitudinal direction such that a first gap 150 is defined between two consecutive slits 120 of the first row 130. Similarly, each second row 132 extends from the first longitudinal end 140 to the second longitudinal end 142 and includes a number of slits 120 arrayed linearly along a longitudinal direction such that a second gap 152 is defined between two consecutive slits 120 of the second row 132. Further, the second row 132 is arranged adjacent/neighboring the first row 130 and the slits 120 of the first row 130 and the slits 120 of the second row 132 are arranged such that each slit 120 of the first row 130 completely overlaps an associated slit 120 of the second row 132 that is disposed facing the slit 120 of the first row 130. In such a case, the first gap 150 also completely overlaps the second gap 152. Accordingly, the slits 120 of the first row 130 and the slits 120 of the second row 132 are disposed in an inline arrangement.

Moreover, each third row 134 extends from the first longitudinal end 140 of the first layer 110 to the second longitudinal end 142 of the first layer 110 and includes a number of slits 120 of the plurality of slits 120. The number of slits 120 of the third row 134 are arrayed linearly along a longitudinal direction of the mattress 100 such that a third gap 154 is defined between two consecutive slits 120 of the third row 134. Further, the third row 134 is arranged adjacent/neighboring the second row 132 such that the second row 132 is arranged between the first row 130 and the third row 134. Similarly, each fourth row 136 extends from the first longitudinal end 140 of the first layer 110 to the second longitudinal end 142 of the first layer 110 and includes a number of slits 120 out of the plurality of the slits 120. The slits 120 of the fourth row 136 are arrayed linearly along a longitudinal direction and disposed spaced apart from each other in the longitudinal direction such that a fourth gap 156 is defined between two consecutive slits 120 of the fourth row 136. Further, the fourth row 136 is arranged adjacent/neighboring the third row 134 and the slits 120 of the third row 134 and the slits 120 of the fourth row 136 are arranged such that each slit 120 of the third row 134 completely overlaps an associated slit 120 of the fourth row 136 that is disposed facing the slit 120 of the third row 134. In such a case, the third gap 154 also completely overlaps the fourth gap 156. Accordingly, the slits 120 of the third row 134 and the slits 120 of the fourth row 136 are disposed in an inline arrangement.

Further, the fourth row 136 is arranged adjacent/neighboring the third row 134 such that the third row 134 is arranged between the second row 132 and the fourth row 136. As shown, the slits 120 of the third row 134 and the slits 120 of the second row 136 are arranged such that each slit 120 of the third row 134 partially overlaps two associated slit 120 of the second row 132 that are disposed facing the slit 120 of the third row 134. In such a case, the slit 120 of the third row 134 completely overlaps the second gap 152 disposed between the two facing slits 120 of the second row 132. Accordingly, a central axis of each slit 120 of the third row 134 is longitudinally offset from a central axis of each of the facing slits 120 of the second row 132. Also, the central axis of the slit 120 of the third row 134 is disposed facing the second gap 152. Accordingly, the slits 120 of the third row 134 and the slits 120 of the second row 132 are disposed in a staggered arrangement.

Also, the fourth row 136 is arranged between the first row 130 and the third row 134. Further, the fourth row 136 is arranged adjacent/neighboring the first row 130. As shown, the slits 120 of the fourth row 136 and the slits 120 of the first row 130 are arranged such that each slit 120 of the fourth row 136 partially overlaps two associated slit 120 of the first row 130 that are disposed facing the slit 120 of the fourth row 136. In such a case, the slit 120 of the fourth row 136 completely overlaps the first gap 150 disposed between the two facing slits 120 of the first row 130. Accordingly, a central axis of each slit 120 of the fourth row 136 is longitudinally offset from a central axis of each of the facing slits 120 of the first row 130. Also, the central axis of the slit 120 of the fourth row 136 is disposed facing the first gap 150. Accordingly, the slits 120 of the fourth row 136 and the slits 120 of the first row 130 are disposed in a staggered arrangement. Also, a spacing between two adjacent rows may be varied depending on the required firmness and/or softness of the first layer 110. Further, the dimensions of the slit 120 may vary depending upon the required softness or firmness of the first layer 110.

As shown in FIG. 4, the slits 120, upon compression of the first layer 110, facilitates in compression of the foam or area of the first layer 110 along the planes of the slits 120 that is under direct loading and prevents the surrounding foam or area of the first layer 110 from being pulled towards the compressed area (i.e., area under direct loading). This isolating action not only prevents pulling but also allows the first layer 110 to articulate and shape better to the human form, because there is no mechanical resistance in the first layer 110 on the other side of the slit 120 from the compression. This modification also serves to minimize motion between people laying on the mattress 100 or causing the plane of the support structure 102 to angle towards the heavier individual.

Referring again to FIG. 1, the second layer 112 includes a substantially convex shape when viewed from a longitudinal side of the mattress 100. As shown, the second layer 112 may include a first end portion 160, a second end portion 162, and a central portion 164 arranged between the first end portion 160 and the second end portion 162. The first end portion 160 may extend from a first longitudinal end 170 of the mattress 100 to the central portion 164, while the central portion 164 may extend from the first end portion 160 to the second end portion 162. The second end portion 162 may extend from the central portion 164 to a second longitudinal end 172 of the mattress 100. It may be appreciated that a thickness of the second layer 112 increases from the first longitudinal end 170 to a middle of the central portion 164, while the thickness of the second layer 112 decreases from the middle of the central portion 164 to the second longitudinal end 172. Accordingly, a thickness of the central portion 164 may be greater than thicknesses of the first end portion 160 and the second end portion 162. Relative higher thickness of the central portion 164 provides/creates a slight lift or a denser feel under the hips of the sleeper, improving the sleep posture such that a more natural and comfortable sleep position can be achieved, even when utilizing softer materials that are subject to easier compression. Although, the second layer 112 is contemplated to be arranged between the first layer 110 and the support structure 102, it may be envisioned that the second layer 112 may be disposed above the first layer 110. In such a case, the first layer 110 is sandwiched between the second layer 112 and the support structure 102. In some embodiments, the second layer 112 may be omitted. In some implementations, the second layer 112 may be made of a form material having a density higher than a density of the foam of the first layer 110. In an embodiment, the apex of the convex of the second layer 112 may be offset in a lateral direction from a middle line of the first layer 110 or the mattress 100. In an embodiment, the foam structure 104 may include a firmer or denser foam material in the center of the mattress 100, under the hips, upper thigh and lower back area, where people typically carry a higher amount of weight—leaving a softer and more conforming foam at the shoulder area of the foam structure 104 for comfort when lying on the side.

Although the mattress 100 having a first group of rows having two rows, for example, the first row 130 and the second row 132, followed by a second group of rows having two rows, for example, third row 134 and the fourth row 136 is contemplated. It may be appreciated that the first group of rows may include more than two rows, for example, three rows and the second group of rows may also include multiple rows, for example, three rows that are arranged in a similar manner. Further, although the slits 120 of the third row 134 and the slits of the fourth row 136 are shown to be arranged in the staggered arrangement relative to the slits 120 of the second row 132 and the first row 130, it may be envisioned that the slits 120 in all the rows, i.e., the first row 130, the second row 132, the third row 134, and the fourth row 136, may be arranged in an inline arrangement.

It should be understood that the foregoing description is only illustrative of the aspects of the disclosed embodiments. Various alternatives and modifications can be devised by those skilled in the art without departing from the aspects of the disclosed embodiments. Accordingly, the aspects of the disclosed embodiments are intended to embrace all such alternatives, modifications, and variances that fall within the scope of the appended claims. Further, the mere fact that different features are recited in mutually different dependent or independent claims does not indicate that a combination of these features cannot be advantageously used, such as a combination remaining within the scope of the aspects of the disclosed embodiments.

What is claimed is:

1. A mattress, comprising:

a layer including a first surface and a second surface arranged opposite to the first surface and defining a plurality of slits extending from the first surface to the second surface and arranged in a plurality of rows extending in a longitudinal direction, wherein the slits in each row are arrayed linearly in the longitudinal direction and are disposed spaced apart from each other, wherein the rows of the slits restrict a compression of the layer to an area under loading and prevent the surrounding portion of the layer from being pulled towards the area under loading, wherein the plurality of rows includes a plurality of first rows, a plurality of second rows arranged adjacent to the plurality of first rows, wherein the slits of the first rows and the slits of the second rows are arranged in an inline arrangement, a plurality of third rows arranged adjacent to the plurality of second rows such that a single second row is arranged between a single first row and a single third row, wherein the slits of the third row and the slits of the second row are arranged in a staggered arrangement, and a plurality of fourth rows arranged adjacent to the plurality of third rows such that a single third row is arranged between a single fourth row and a single second row and the single fourth row is arranged between an adjacently arranged single third row and an adjacently arranged single first row, wherein the slits of the fourth row and the slits of the third row are arranged in an inline arrangement.

2. The mattress of claim 1, wherein each first row includes a number of slits arranged spaced apart from each other such that a first gap is defined between two consecutively arranged slits of the first row, and each second row includes a number of slits arranged spaced apart from each other such that a second gap is defined between two consecutively arranged slits of the second row, wherein the second gap is disposed facing the first gap of the adjacently arranged first row and completely overlaps the facing first gap.

3. The mattress of claim 2, wherein each third row includes a number of slits arranged spaced apart from each other such that a third gap is defined between two consecutively arranged slits of the third row, wherein the third gap is arranged facing the slit of the adjacently arranged second row such that the slit of the adjacently arranged second row completely overlaps the facing third gap, and each fourth row includes a number of slits arranged spaced apart from each other such that a fourth gap is defined between two consecutively arranged slits of the fourth row, wherein the fourth gap is disposed facing the third gap of the adjacently arranged third row and completely overlaps the facing third gap.

4. The mattress of claim 3, wherein the fourth gap is arranged facing the slit of the adjacently arranged first row such that the slit of the adjacently arranged first row completely overlaps the facing fourth gap.

5. The mattress of claim 1 further including a support structure supporting the layer and includes a plurality of springs.

6. The mattress of claim 1, wherein the layer is a first layer and the mattress includes a second layer attached to the second surface of the first layer.

7. The mattress of claim 6, wherein the second layer includes a convex shape when viewed from a longitudinal side of the mattress.

8. The mattress of claim 7, wherein an apex of the second layer is offset from a middle line of the mattress.

9. The mattress of claim 6, wherein the first layer is made of foam and the second layer is made of foam having a density higher than a density of the first layer.

10. A mattress, comprising:

a base structure; and a foam structure attached to the base structure and supported on the base structure, the foam structure including a layer having a first surface and a second surface arranged opposite to the first surface and defining a plurality of slits extending from the first surface to the second surface and arranged in a plurality of rows extending in a longitudinal direction, wherein the slits in each row are arrayed linearly in the longitudinal direction and are disposed spaced apart from each other, wherein the rows of the slits restrict a compression of the layer to an area under loading and prevent the surrounding portion of the layer from being pulled towards the area under loading, wherein the plurality of rows includes a plurality of first rows, a plurality of second rows arranged adjacent to the plurality of first rows, wherein the slits of the first rows and the slits of the second rows are arranged in an inline arrangement, a plurality of third rows arranged adjacent to the plurality of second rows such that a single second row is arranged between a single first row and a single third row, wherein the slits of the third row and the slits of the second row are arranged in a staggered arrangement, and a plurality of fourth rows arranged adjacent to the plurality of third rows such that a single third row is arranged between a single fourth row and a single second row and the single fourth row is arranged between an adjacently arranged single third row and an adjacently arranged single first row, wherein the slits of the fourth row and the slits of the third row are arranged in an inline arrangement.

11. The mattress of claim 10, wherein each first row includes a number of slits arranged spaced apart from each other such that a first gap is defined between two consecutively arranged slits of the first row, and each second row includes a number of slits arranged spaced apart from each other such that a second gap is defined between two consecutively arranged slits of the second row, wherein the second gap is disposed facing the first gap of the adjacently arranged first row and completely overlaps the facing first gap.

12. The mattress of claim 11, wherein each third row includes a number of slits arranged spaced apart from each other such that a third gap is defined between two consecutively arranged slits of third row, wherein the third gap is arranged facing the slit of the adjacently arranged second row such that the slit of the adjacently arranged second row completely overlaps the facing third gap, and each fourth row includes a number of slits arranged spaced apart from each other such that a fourth gap is defined between two consecutively arranged slits of the fourth row, wherein the fourth gap is disposed facing the third gap of the adjacently arranged third row and completely overlaps the facing third gap.

13. The mattress of claim 12, wherein the fourth gap is arranged facing the slit of the adjacently arranged first row such that the slit of the adjacently arranged first row completely overlaps the facing fourth gap.

14. The mattress of claim 10, wherein the support structure includes a plurality of springs attached to the foam structure and supporting the foam structure.

15. The mattress of claim 10, wherein the layer is a first layer and the foam structure includes a second layer sandwiched between the first layer and the support structure and attached to the second surface of the first layer.

16. The mattress of claim 15, wherein the second layer includes a convex shape when viewed from a longitudinal side of the mattress.

17. The mattress of claim 16, wherein an apex of the second layer is offset from a middle line of the mattress.

18. The mattress of claim 15, wherein the first layer is made of foam and the second layer is made of foam having a density higher than a density of the first layer.

* * * * *